US011718378B2

(12) United States Patent
Rantala et al.

(10) Patent No.: US 11,718,378 B2
(45) Date of Patent: Aug. 8, 2023

(54) WATER-JET PROPULSION UNIT AND A BOAT

(71) Applicant: ALAMARIN-JET OY, Härmä (FI)

(72) Inventors: Hannu Rantala, Ylihärmä (FI); Tuomas Ruosteinen, Vantaa (FI)

(73) Assignee: ALAMARIN-JET OY, Harma (FI)

( * ) Notice: Subject to any disclaimer, the term of this patent is extended or adjusted under 35 U.S.C. 154(b) by 275 days.

(21) Appl. No.: 17/286,789

(22) PCT Filed: Oct. 22, 2019

(86) PCT No.: PCT/FI2019/050747

§ 371 (c)(1),
(2) Date: Apr. 19, 2021

(87) PCT Pub. No.: WO2020/084193

PCT Pub. Date: Apr. 30, 2020

(65) Prior Publication Data

US 2021/0339838 A1 Nov. 4, 2021

(30) Foreign Application Priority Data

Oct. 22, 2018 (FI) ..... 20185884

(51) Int. Cl.
*B63H 11/08* (2006.01)
*B63H 11/11* (2006.01)
*B63H 11/113* (2006.01)

(52) U.S. Cl.
CPC ..... *B63H 11/08* (2013.01); *B63H 11/11* (2013.01); *B63H 11/113* (2013.01); *B63H 2011/081* (2013.01)

(58) Field of Classification Search
CPC ..... B63H 11/00; B63H 11/08; B63H 11/11; B63H 11/113; B63H 2011/081
(Continued)

(56) References Cited

U.S. PATENT DOCUMENTS 3,089,454 A * 5/1963 Chronic ..... B63H 11/11 440/42
3,859,951 A * 1/1975 Woodfill ..... B63H 11/04 440/43

(Continued)

FOREIGN PATENT DOCUMENTS

WO 2014044917 A1 3/2014

OTHER PUBLICATIONS

Finnish Search Report in corresponding Finnish Patent Application No. 20185884, dated Apr. 15, 2019, 1 page.

(Continued)

*Primary Examiner* — Lars A Olson
(74) *Attorney, Agent, or Firm* — FisherBroyles, LLP; Robert Kinberg

(57) ABSTRACT

A water-jet propulsion unit includes a body, an impeller for moving water, the impeller disposed in an impeller tunnel, an impeller shaft for driving the impeller, a first bearing housing to support the impeller shaft on the body, and a jet nozzle for forming a water jet. The body comprises a shaft opening for the impeller, a flow duct having a first contact surface, an inlet opening, and an outlet opening, the planes of which are at an angle α relative to each other. The impeller tunnel has a first end comprising a planar second contact surface and a second end comprising a planar third contact surface to seal the impeller tunnel between the body and the jet nozzle. The second and third planar contact surfaces of the impeller tunnel are arranged at an angle relative to each other. The impeller shaft is adapted for alternative types of installation by turning the impeller tunnel through 180° about the rotational axis of the impeller shaft. Support equipment supports the impeller shaft on the body in the alternative positions.

16 Claims, 10 Drawing Sheets

(58) Field of Classification Search
USPC ..... 440/38
See application file for complete search history.

(56) References Cited

U.S. PATENT DOCUMENTS 6,062,922 A 5/2000 Nanami
6,299,494 B1 * 10/2001 Bowers ..... B63H 11/113
440/42

OTHER PUBLICATIONS

International Search Report in corresponding International Application No. PCT/FI2019/050747, dated Feb. 5, 2020, 2 pages.

* cited by examiner

SECTION B-B

WATER-JET PROPULSION UNIT AND A BOAT

CROSS-REFERENCE TO RELATED APPLICATIONS

This application is a United States National Stage Application of International Application No. PCT/FI2019/050747 filed Oct. 22, 2019, claiming priority from Finnish Patent Application No. 20185884 filed Oct. 22, 2018.

FIELD OF THE INVENTION

The invention relates to a water-jet propulsion unit, which is arranged to be installed and sealed to at least one water-jet propulsion unit installation opening belonging to a boat, which water-jet propulsion unit includes

- a body,
- an impeller for moving water, the impeller including an impeller tunnel,
- an impeller shaft for driving the impeller,
- a first bearing housing to support the impeller shaft on the body,
- a jet nozzle for forming a water jet,
- in which the body comprises
  - at least a first contact surface for attaching the body to the boat,
  - a flow duct, which includes an inlet opening installed in the boat parallel to its bottom, and an outlet opening parallel to the stern for guiding the water to the impeller in the impeller tunnel, which inlet opening and outlet opening are at an angle $\alpha$ relative to each other, and
  - a shaft opening for the impeller shaft,
- and in which the first bearing housing is connected to the body to support the impeller shaft on it, which impeller shaft runs through the flow duct,
- and in which the impeller has a first end comprising a second contact surface and a second end comprising a third contact surface for sealing the impeller tunnel between the body and the jet nozzle.

The invention also relates to a boat.

BACKGROUND OF THE INVENTION

A water-jet propulsion unit is driven by an engine to form a water jet that moves a boat forwards. The engine is attached to the boat inside its hull. Inside the boat the engine must be placed in such a way that the engine's sump is free from the bottom of the boat. On the other hand, the location of the engine is also determined according to the impeller shaft belonging to the water-jet unit. In some engines, the engine's height permits the engine and the water-jet unit to be installed in the boat in such a way that the impeller shaft is supported parallel to the bottom of the boat. On the other hand, in some engines the construction of the engine block and its sump force the engine to be mounted higher in the boat to keep the sump free from the boat's bottom, in which case the impeller shaft and the water-jet unit are installed at an angle to the boat's bottom relative to the boat's direction of travel.

Due to the differences in installation, the user must decide on the method of installing the water-jet propulsion unit already when ordering the boat, as the boat is made according to the water-jet unit. Due to the differences in types of installation, the properties achieved using the water-jet unit vary, and each type has its own advantages. In other words, a water-jet unit can only be installed in one way in a boat made for a chosen type of installation, without significant changes to the boat, the water-jet unit, or both.

A water-jet propulsion unit is known from publication U.S. Pat. No. 6,062,922, in which the engine can be installed higher to avoid contact between the engine's sump and the boat's bottom. In the publication, the direction of the water jet formed by the water-jet unit is altered using separate adapter pieces, which permit the impeller tunnel to be installed at an angle to the boat's stern and the jet nozzle to be installed at an angle to the impeller tunnel. However, the construction according to the publication is complicated, comprising several parts, nor does the construction permit the water jet unit to be installed using alternative types of installation, without changes to the boat or the water-jet unit, or both.

SUMMARY OF THE INVENTION

The invention is intended to create a simpler water-jet propulsion unit than water-jet propulsion units of the prior art, which can be installed in alternative ways in a boat, without additional components. The invention is also intended to create a more versatile boat than boats of the prior art, in which the manner of installing a water-jet propulsion unit can be chosen more freely than in boats according to the prior art.

The water-jet propulsion unit according to the invention is characterized by a water-jet unit that is arranged to be installed and sealed to at least one water-jet unit installation opening belonging to a boat. The water jet unit includes a body, an impeller for moving water, the impeller including an impeller tunnel, an impeller shaft for driving the impeller, a first bearing housing to support the impeller shaft on the body, and a jet nozzle to form a water jet. The body comprises at least a first contact surface for attaching the body to a boat, a flow duct comprising an inlet opening installed in the boat parallel to the bottom, and an outlet opening parallel to the stern for guiding water to the impeller in the impeller tunnel, the planes of which inlet opening and outlet openings are at an angle $\alpha$ relative to each other, and a shaft opening for the impeller shaft. A first bearing housing is connected to the body to support the impeller shaft where the impeller shaft penetrates the flow duct. The impeller tunnel has a first end comprising a second contact surface and a second end comprising a third contact surface for sealing the impeller tunnel between the body and the jet nozzle. The impeller is arranged for alternative types of installation, in that there is an angle $\Omega$ between the impeller's second and third contact surfaces and the impeller is arranged to be rotatable through 180° around the rotational axis of the drive shaft in order to permit alternative angles of the impeller shaft. In addition, the water jet unit includes support equipment to support the impeller shaft, in alternative positions to permit alternative angles of the impeller shaft in alternative types of installation.

The water-jet propulsion unit according to the invention can be installed in two alternative types of installation to each other using the same components, by only turning the impeller by 180° relative to the rotation axis of the impeller shaft. The asymmetrical impeller tunnel then permits the water-jet unit's impeller shaft to be supported at two different angles. The support means in turn permit different lines of the impeller shaft between different types of installation by supporting the impeller shaft with the aid of the first bearing housing at different positions in the body. Thus, the water-jet unit can be installed with the impeller shaft angle according to the customer's wishes, even though the type of installation is not known before the boat is ordered.

The angle α preferably exceeds a right-angle by an additional angle β. In other words, it can also be determined that the lower surface of the water-jet unit's body is parallel to the boat's bottom and relative to this the surface of the body's outlet openings is at an angle that exceeds a right-angle by an additional angle β.

Preferably there is a shaft opening in the shaft duct for the impeller shaft and the said shaft duct includes an enlargement to allow alternative angles of the impeller shaft in different types of installation. The shaft-duct enlargement in turn permits different lines of the impeller shaft between different types of installation, without contact with the body of the water-jet unit.

Alternatively, the shaft connection can also be simply an opening in the flow duct, through which the impeller shaft fits.

The angle Ω is preferably equal to the additional angle β. The water jet propulsion unit can then be installed either parallel to the angle or fully parallel to the boat's bottom.

In the flow duct, the first contact surface is preferably arranged in connection with the inlet opening and the flow duct additionally includes a fourth contact surface arranged in connection with the outlet opening, the flow duct being arranged to be installed inside the boat, the inlet and outlet openings being aligned with the boat's installation openings. The water-jet unit's body fitted inside the boat can then be used.

Alternatively, the body can include only a first contact surface, when the flow duct's inlet and outlet openings will not be on the contact surfaces, instead the water-jet unit is installed in a recess in the boat. The water jet unit can then be sealed at least mainly on the boat's outer surface.

The body preferably includes an installation flange, in which the outlet opening and fourth contact surface are formed. With the aid of the installation flange the water-jet unit's body can be tightly attached to the boat's stern.

The angle α is preferably 91-93° and the angle Ω and the additional angle β each correspondingly 1-3°. Then by turning the impeller tunnel 180° relative to the rotation axis of the water-jet unit's impeller shaft the water-jet unit can be installed either parallel to the boat's bottom or at an angle of twice angle Ω, i.e. 2-6°, without using separate intermediate pieces or other additional components.

According to a first embodiment, the support means are the first bearing housing, which is asymmetrical with the shaft opening located eccentrically in the first bearing housing. The change of angle of the impeller shaft caused by the turning of the impeller tunnel can then be taken into account simply also in the support of the impeller shaft on the water-jet unit's body by also turning the bearing housing 180° relative to the impeller shaft's rotation axis.

According to a second embodiment, the support means are alternative attachment locations belonging to the body for the first bearing housing, and the first bearing housing is symmetrical with the shaft opening located centrally in the first bearing housing. The attachment of the bearing housing to the body can then be moved between the different attachment locations to take into account the change in the angle of the impeller shaft between different installation types.

The shaft duct preferably has an ovally or elliptically shaped cross-section in the radial direction of the impeller shaft. The change in angle of the impeller shaft can then be implemented without changing the attitude of the water-jet propulsion unit, as sufficient space has been formed for the impeller shaft in the shaft duct to permit both attitudes. An ovally-shaped opening is smaller in size than a completely circular one and thus weakens the body's structure less.

Alternatively, the shaft duct can have a circular cross-section.

The water-jet propulsion unit preferably includes a packing box to seal the impeller shaft to the body, which packing box comprises an ovally shaped sealing opening in the vertical direction for the impeller shaft. With the aid of the packing box the impeller shaft is sealed in both attitudes of the impeller shaft, using the same packing box, as the ovally shaped sealing opening allows different attitudes of the impeller shaft.

Alternatively, the sealing opening can also be circular, when it will be easier to manufacture.

The impeller tunnel is preferably in one piece. It is then easy to make and seal as part of the water-jet unit with the aid of the second and third contact surfaces. The installation of the water-jet unit is then also simple and rapid.

Alternatively, the impeller tunnel can be in two pieces, when the second and third contact surfaces can be fitted to the separate parts of the impeller tunnel, when turning one or both parts through 180° creates a change in angle of the impeller shaft.

The water-jet unit's body is preferably in one piece. It can then be manufactured, for example, as a cast piece. On the other hand, the flow duct of a one-piece body is always sealed between the inlet opening and the outlet opening, because the flow duct does not comprise joints. In addition, it is quicker to install a one-piece body than a multi-piece body.

A second bearing housing is preferably integrated with the jet nozzle to support the impeller shaft. With the aid of the second bearing housing, the support of the impeller shaft is implemented at the other end of the water-jet unit relative to the bearing housing attached to the body. Support of the impeller shaft implemented with the aid of two bearing housings is rugged.

Alternatively, the support of the impeller shaft can also be implemented using only the first bearing housing, if the bearing housing's support is extremely sturdy.

The boat according to the invention is characterized by a boat, which includes a hull comprising a bottom, sides, and a stern, a water jet propulsion unit installed in the boat's hull, the water-jet unit's engine installed inside the boat's hull, and installation openings for the water-jet unit. The first installation opening is fitted to the bottom and the second installation opening to the stern. The water jet unit is a water-jet unit according to any of the afore-mentioned embodiments, and the angle θ between the boat's bottom and stern is equal to the water-jet unit's angle α.

In the boat according to the invention, the water-jet unit's installation angle can be freely chosen between an installation angle parallel to the bottom of the boat and a tilted angle relative to the bottom of the boat. The different installation angles do not demand changing components or the use of additional components, but only the turning of the water-jet unit's impeller tunnel.

Preferably the boat's engine is connected to the water-jet propulsion unit by a direct drive. Thus, there is no need for a generally-used vertical-offset gearbox between the engine and the water-jet unit.

BRIEF DESCRIPTION OF THE DRAWINGS

In the following, the invention is described in detail with reference to the accompanying drawing showing some embodiments of the invention, in which.

DETAILED DESCRIPTION OF THE INVENTION

Figure 1A:
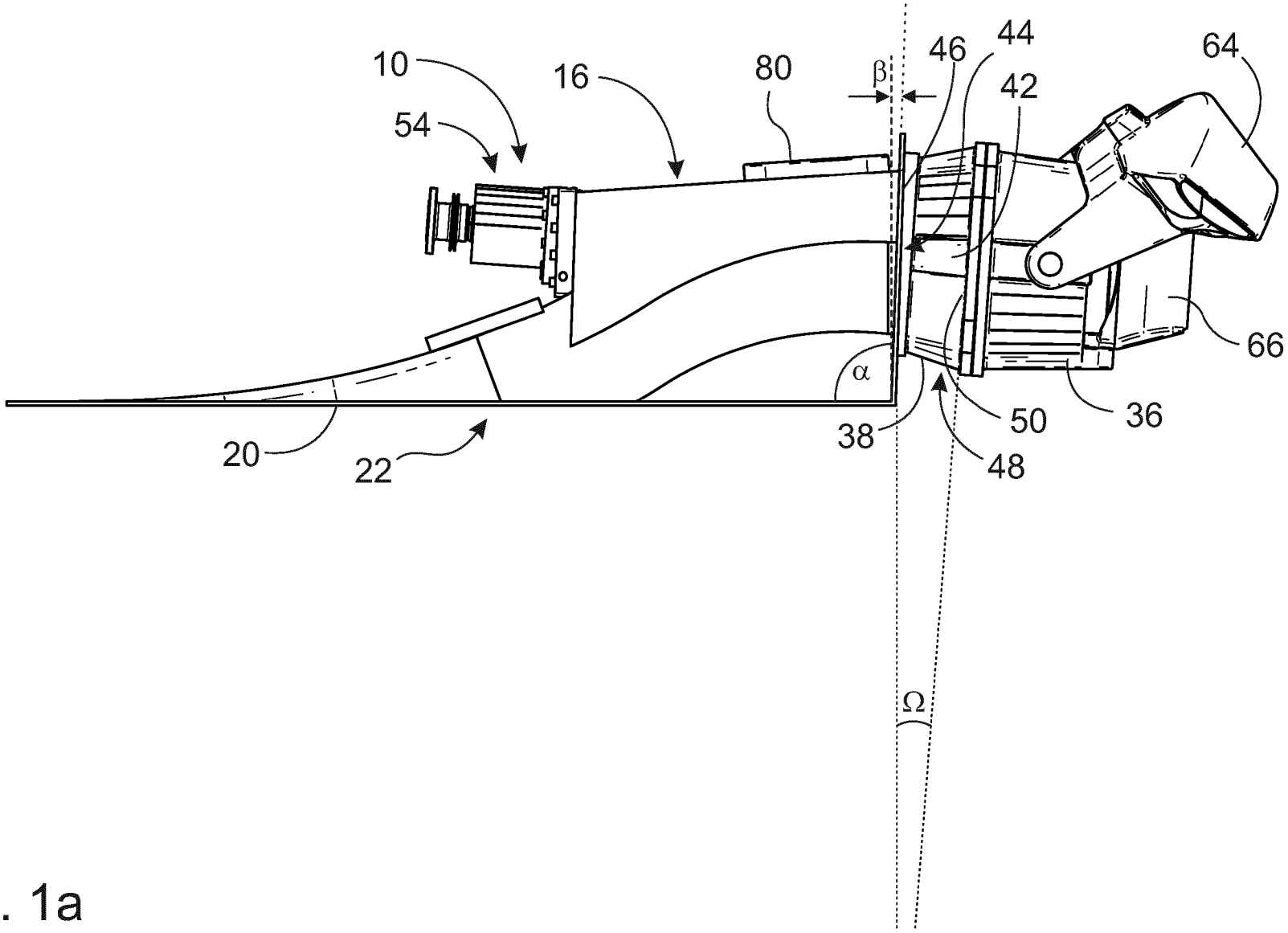
FIG. 1*a* shows the water-jet unit according to the invention seen from the side of the boat, assembled according to the first type of installation.
Figure 1B:
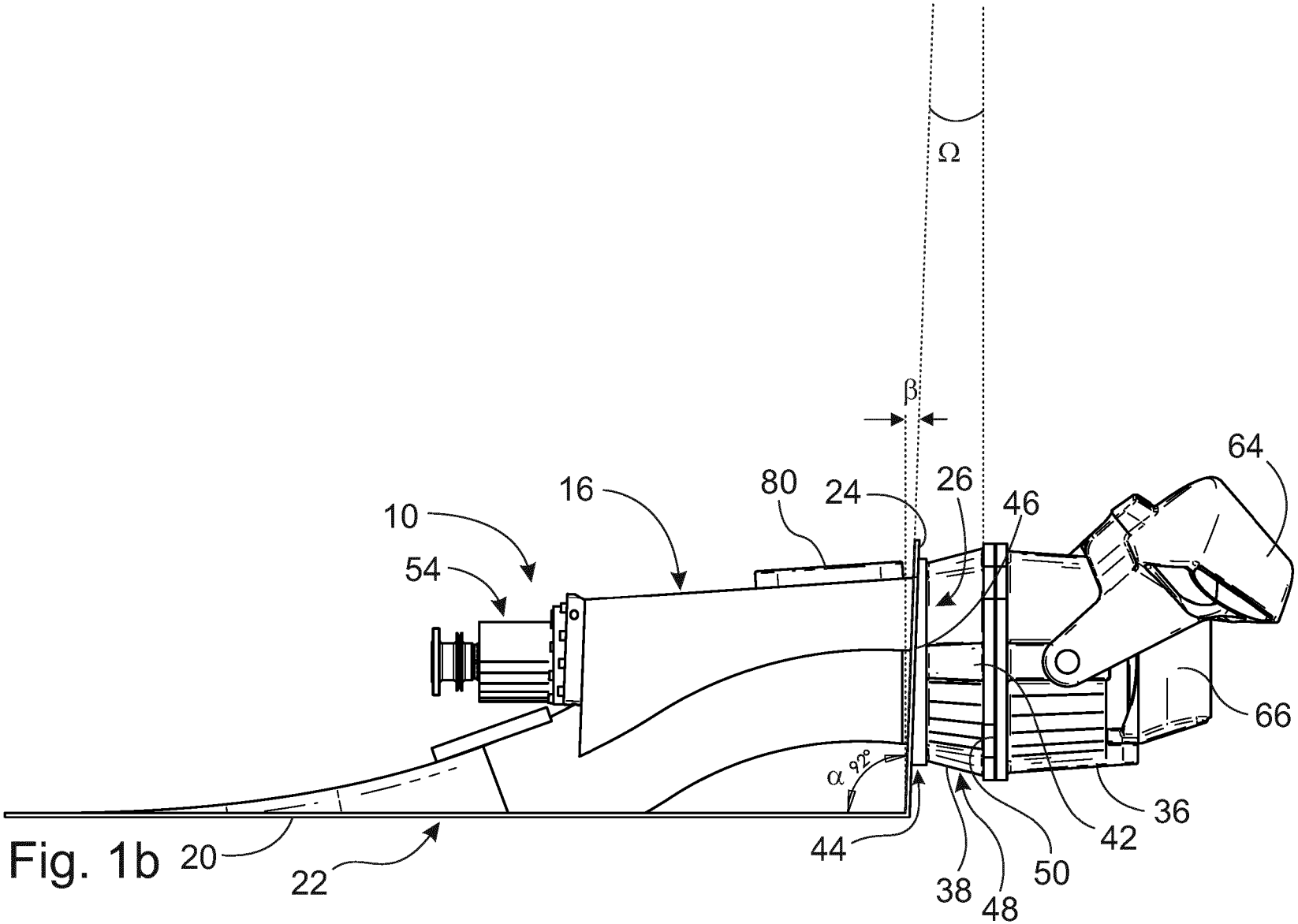
FIG. 1*b* shows the water-jet unit according to the invention seen from the side of the boat, assembled according to the second type of installation.

The water-jet propulsion unit 10 according to the invention includes, like water-jet propulsion units according to the prior art, a body 16, an impeller tunnel 38, a jet nozzle 36, and a steering nozzle 66, all visible in FIGS. 1*a* and 1*b*. The body 16 is installed inside the boat 12 according to FIG. 1*a*, whereas the impeller tunnel 38 and the impeller 28 inside it, the jet nozzle 36, and the steering nozzle 66 are outside the boat's stern 74. In the embodiment according to FIGS. 1*a*-4*d*, the water-jet unit 10 is installed in installation openings 14 formed in the boat 12, of which the first installation opening 14.1 is formed in the boat's 12 bottom 72 and the second installation opening 14.2 in the boat's stern 74. The body 16 includes the inlet opening's 22 first contact surface 20 for sealing between the body 16 and the boat's 12 bottom 72 and a fourth contact surface 24 for sealing between the body 16 and the impeller tunnel 38. In the water jet unit 10 according to the invention, the inlet opening 22 and the outlet opening 26 are at an angle α relative to each other's planes, which exceeds a right-angle by an additional angle β. Preferably the first contact surface 20 and the fourth contact surface 24 in the water-jet unit 10 are at the same angle α to each other relative to their planes, which exceeds a right-angle by an additional angle β. Correspondingly, according to FIG. 2*c*, in the boat 12 according to the invention, the angle θ between the stern 74 and the bottom 72 equals angle α. Thus, the body 16 lies tightly against the boat's 12 stern 74 and bottom 72.

Alternatively to the embodiment shown in FIGS. 1*a*-4*d*, the water jet propulsion unit can also be attached to a boat, in which there is only one slanting installation opening, when the water-jet unit's body includes correspondingly only a slanting first contact surface, with the aid of which the water-jet unit is sealed to the boat's installation opening at least mainly from outside the boat. In this type of installation, the flow duct's inlet opening is not on the first contact surface. The type of installation of such an embodiment corresponds to the type of installation of the water-jet propulsion unit marketed by the applicant under the AJ 285 COMBI FRAME name.

In accordance with the prior art, the impeller tunnel 38 includes a second flow duct 40, which is formed by a flange 42, which has a first end 44 and a second end 48. The first end 44 includes a second contact surface 46 for sealing the impeller tunnel 38 to the body 16 and the second end 48 includes a third contact surface 50 for sealing the impeller tunnel 38 to the jet nozzle 36. The jet nozzle can also be termed a stator. The two alternative types of installation p1 and p2 of the water-jet unit according to the invention are created by the impeller tunnel's 38 second contact surface 46 and third contact surface 50 being at an angle Ω to each other relative to their planes, thus permitting the impeller tunnel 38 to be turned around the impeller shaft's rotation axis by 180°. The angle Ω preferably equals the additional angle β, when in installing the impeller tunnel 38 in such a way that the third contact surface 50 is at right-angles to the boat's 12 bottom 72, the jet nozzle 36 and the steering nozzle 66 can be installed parallel to the boat's 12 bottom. On the other hand, in installing the impeller tunnel 38 in such a way that the third contact surface 50 is at a slanting angle relative to the normal of the boat's 12 bottom 72, the jet nozzle 36 and the steering nozzle 66 can be installed at an angle relative to the boat's 12 bottom. In this case this angle is twice the size of the angle Ω. Thus, it is possible to install the water jet unit in two alternative ways according to FIGS. 3*a* and 3*b*, at the same time changing the distance between the engine 32 and the boat's 12 bottom 72. At the same time, the engine 32 can be as close as possible to the boat's stern 74, leaving plenty of space inside the boat 12 for other purposes. In accordance with the prior art, the engine can be supported on the boat using an engine bed and support pads supported on the boat's bottom and sides (not shown in the figures).

Alternatively, the angle Ω can be of a different size to the additional angle β, but then neither of the types of installation will lead to the impeller shaft being installed parallel to the boat's bottom, instead the impeller shaft will remain at at least a small angle relative to the plane of the boat's bottom.

Figure 3A:
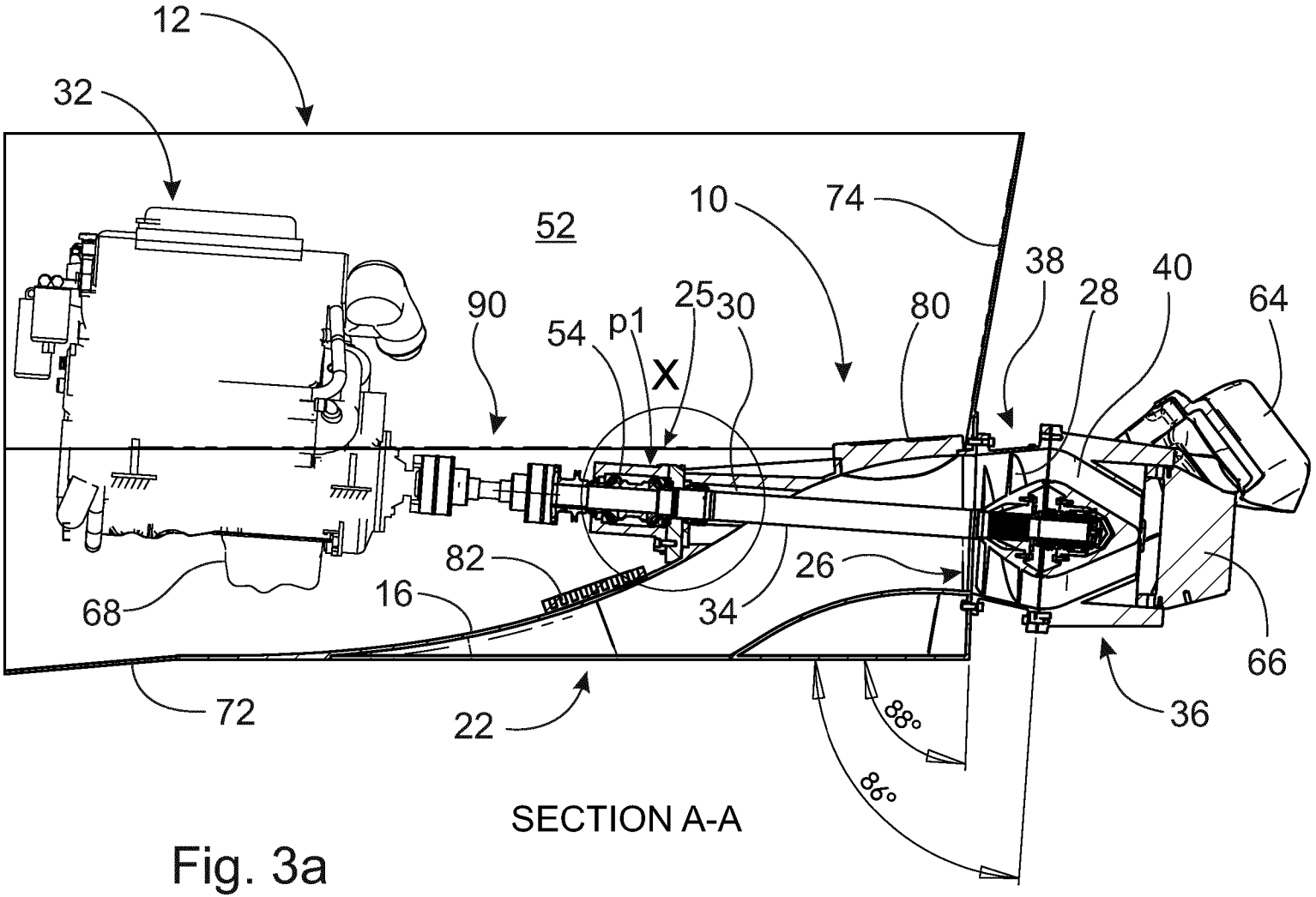
FIG. 3*a* shows a side view of the boat and water-jet unit according to the invention as a partial cross-section, assembled according to the first type of installation.
Figure 3B:
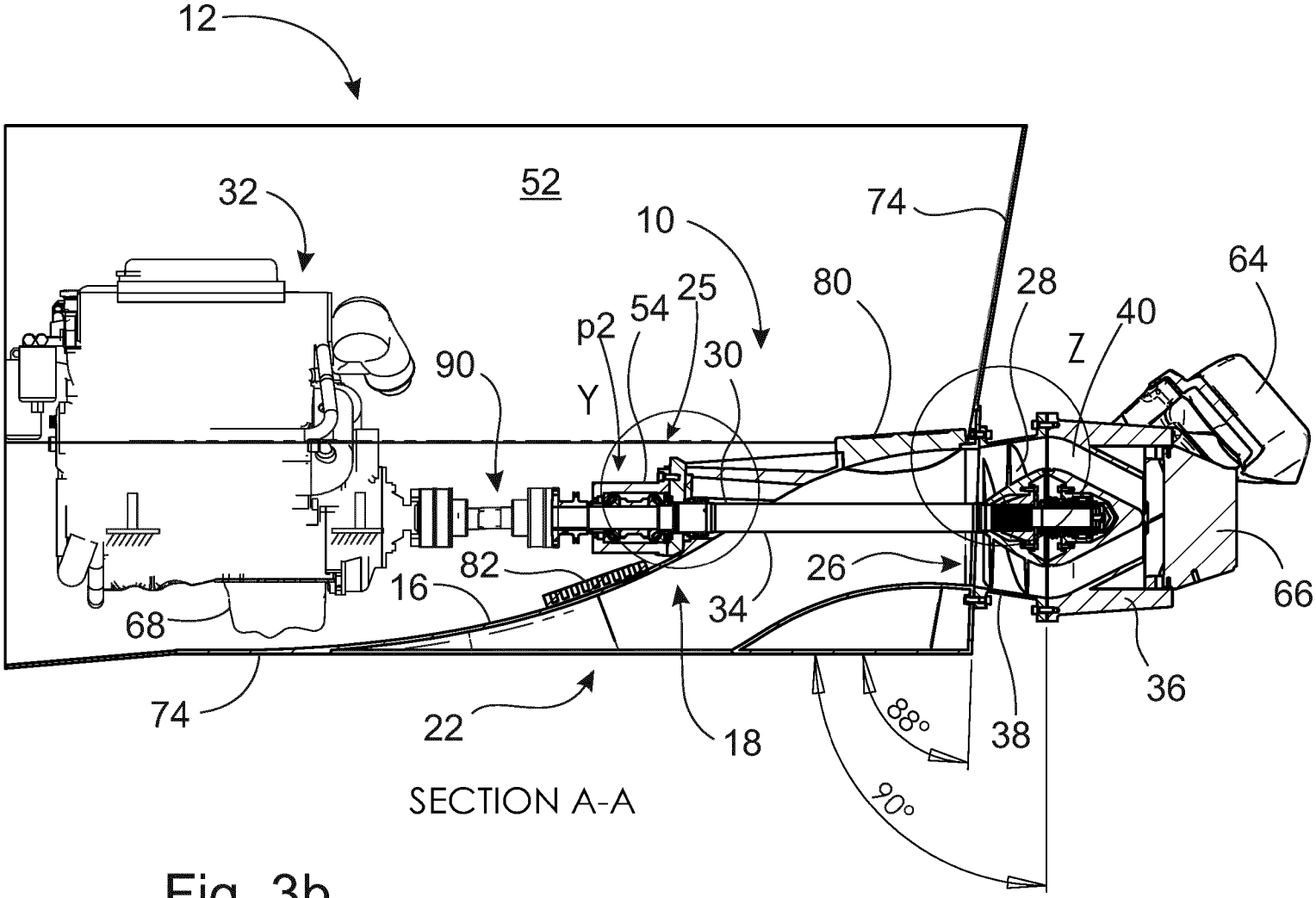
FIG. 3*b* shows a side view of the boat and water-jet unit according to the invention as a partial cross-section, assembled according to the second type of installation.

In accordance with the prior art, the water-jet unit's 10 impeller 28 is rotated with the aid of the engine's 32 impeller shaft 34, which is shown in FIGS. 3*a* and 3*b*. The engine 32 is a separate part from the water-jet unit 10, which is, however, needed to drive the water-jet unit 10. The impeller shaft 34 is supported on the end nearest the engine 32 on the body 16 by the first bearing housing 54 belonging to the water-jet unit 10. At the other end the impeller shaft 34 is supported, according to the enlargement of FIG. 4*c*, on the second bearing housing 96. In accordance with the prior art, the second bearing housing 96 is part of the jet nozzle 36.

Figure 4A:
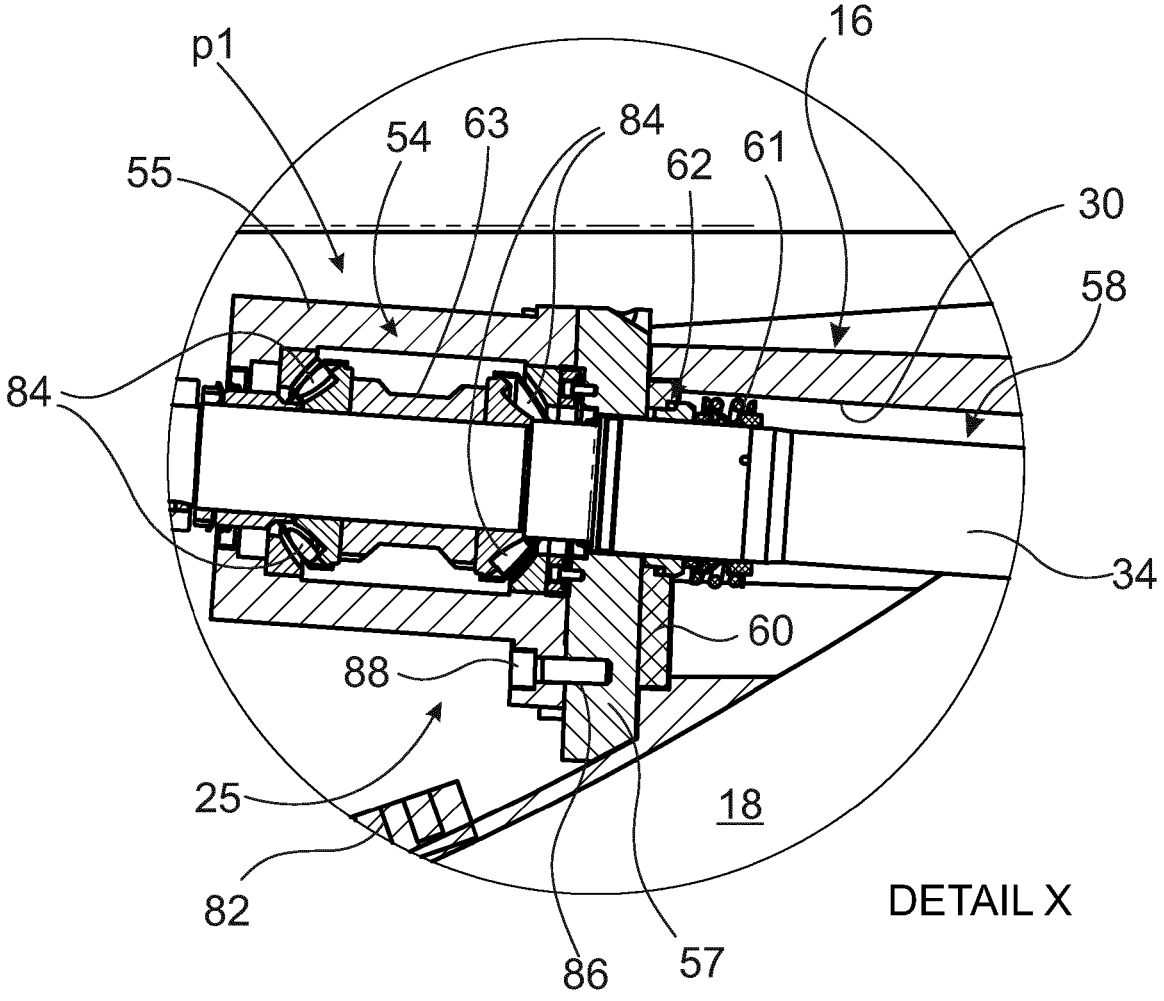
FIG. 4*a* shows an enlargement of detail X of FIG. 3*a*.

According to the invention, by turning the impeller tunnel 38 the attitude of the jet nozzle 36 and the steering nozzle 66 relative to the boat's 12 bottom 72 changes, when the attitude of the second bearing housing 96 also changes. This in turn leads to a change in the angle of the impeller shaft 34, which affects the entire impeller shaft 34. So that the impeller shaft 34 can also be supported on the first bearing housing 54 in both installation attitudes, the attitude of the first bearing housing 54 must be changed with the aid of the support means 25 belonging to the water-jet unit 10. According to a first embodiment, the support means 25 are the first bearing housing 54, which is asymmetrical, i.e. the shaft opening 56 located in it is placed eccentrically, so that the first bearing housing 54 supports the impeller shaft 34 eccentrically on the body 16, according to the enlargements of FIGS. 4*a* and 4*b*. In FIG. 4*a* the first bearing housing 54 is supported on the body 16, permitting the jet nozzle 36 and the steering nozzle 66 to be installed parallel to the boat's bottom, whereas in FIG. 4*b* the first bearing housing 54 is supported on the body 16, permitting the jet nozzle 36 and the steering nozzle 66 to be installed at an angle relative to the direction of the boat's bottom.

According to an alternative second embodiment, the support means are alternative attachment locations belonging to the body, with the aid of which the preferably symmetrical bearing housing can be attached to the body at optional installation locations, according to the type of installation chosen. If the impeller tunnel is installed in such a way that the jet nozzle and the steering nozzle are at an angle relative to the boat's bottom, the bearing housing is then attached to the upper attachment location. On the other hand, if the impeller tunnel is installed in such a way that the jet nozzle and the steering nozzle are parallel to the boat's bottom, the bearing housing is then attached to the lower attachment location. Such a manner of implementation demands, however, two attachment locations, unlike the use of an asymmetrical bearing housing, in which the same attachment location can be used in both attitudes by only turning the bearing housing through 180° relative to the impeller shaft's rotation axis.

In accordance with the prior art, the impeller shaft 34 penetrates the body 16 and the flow duct 18 formed inside it. To feed the impeller shaft 34 through, the body 16 includes a shaft opening 30, which can be a shaft duct 33 or, according to its name, only an opening penetrating the flow duct 18. The shaft opening 30 is preferably a shaft duct 33, through which the impeller shaft 34 runs. Because in the water-jet propulsion unit 10 according to the invention the angle of the impeller shaft 34 changes between the different installation attitudes of the water-jet unit, the shaft duct 33 includes an enlargement 58 to permit alternative angles of the impeller shaft 34 in different types of installation. In different types of installation, the vertical location of the impeller shaft inside the body changes, demanding space to keep the impeller shaft free from the shaft duct walls. With the aid of the enlargement 58 the impeller shaft 34 will not catch on the upper or lower surface of the shaft duct. A shaft duct 33 equipped with an enlargement 58 preferably has an oval-shaped cross-section in the vertical direction, which can be seen in FIG. 4*d*. Alternatively, the shaft duct's cross-section can also be shaped as a larger circle, but this is more difficult to seal than an oval-shaped shaft duct.

In accordance with the prior art, the shaft duct 33 must be sealed with the aid of a packing box 60 coming inside the shaft duct 33, so that water will not enter the boat 12 from the flow duct 18 through the shaft duct 33, more particularly from between the shaft duct 33 and the impeller shaft 34. In the water jet unit 10 according to the invention, the shaft duct 33 is, according to FIG. 4*a*, preferably sealed using a packing box 60 for the sealing, which comprises an oval-shaped sealing opening 62 in the vertical direction for the impeller shaft 34. The location of the sealing opening of the packing box also needs to be changed when the angle of the impeller shaft changes.

FIGS. 1*a*, 3*a*, and 4*a* show a first type of installation of the water-jet propulsion unit 10 according to the invention, in which the impeller shaft 34 lies at an angle relative to the boat's 12 bottom 72. This angle is preferably 4°, which comes from the fact that the angle α between the boat's 12 bottom 72 and its stern is 92°, causing a 2° additional angle β relative to the direction of the boat's 12 bottom 72, and the impeller tunnel 38 is turned in such a way that the third contact surface 50 of the asymmetrical impeller tunnel 38 is at the angle Ω relative to the vertical, causing a slant of another 2°. To support the impeller shaft 34 on the body 16, the asymmetrical first bearing housing 54 is turned so that the first bearing housing's 54 shaft opening 56 is located above the centre line of the first bearing housing 54. Correspondingly, the packing box is also turned to that the sealing opening is above the centre line. In this type of installation, the engine 32 producing the drive power for the water-jet unit 10 is farther from the boat's 12 bottom 72 than in the other type of installation. An engine can then be used in the boat, in which the engine's block or sump is high and the engine demands a great deal of space beneath it, so that it does not touch the boat's bottom.

Figure 4B:
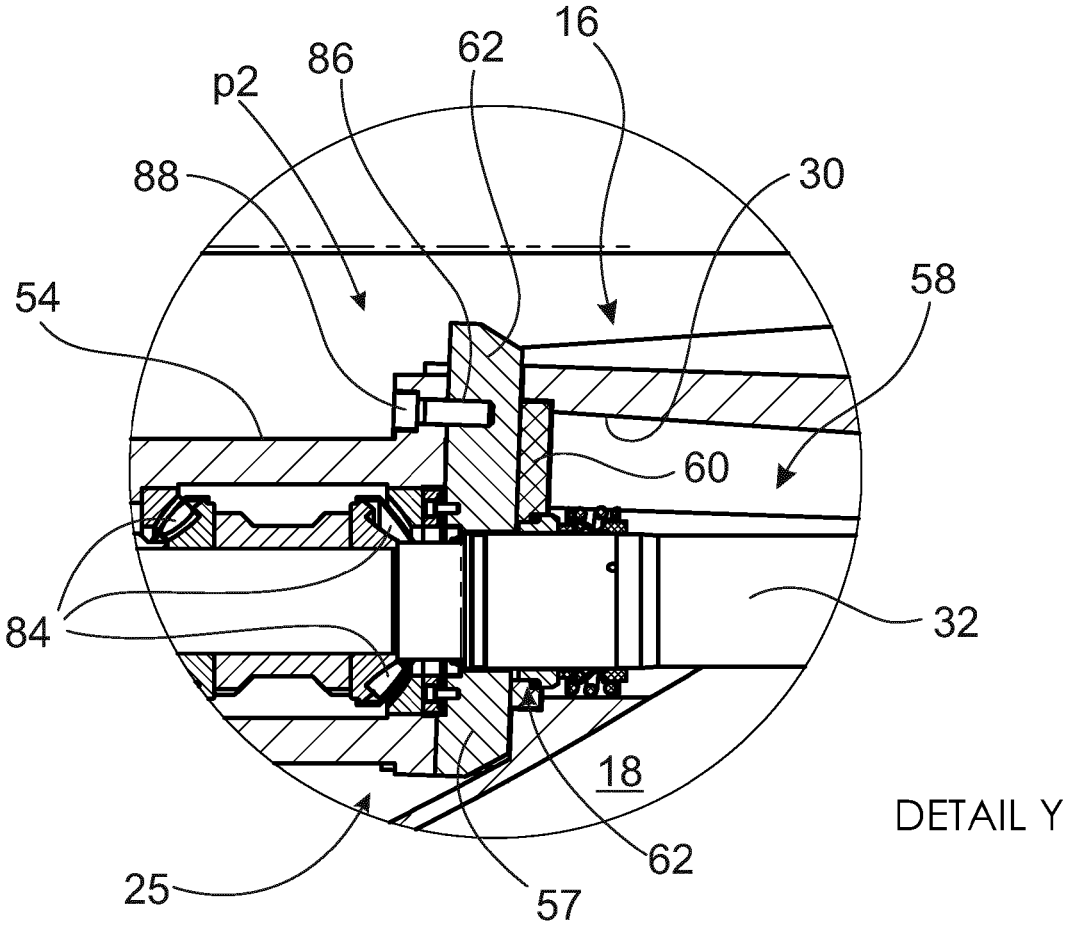
FIG. 4*b* shows an enlargement of detail Y of FIG. 3*b*.

FIGS. 1*b*, 3*b*, and 4*b* show a second type of installation of the water-jet propulsion unit 10, in which the impeller shaft 34 is set parallel to the boat's 12 bottom 72. This is achieved if the angle α between the boat's 12 bottom 72 and its stern is 92°, causing a 2° additional angle β relative to the direction of the boat's 12 bottom 72, and the impeller tunnel 38 is turned so that the third contact surface 50 of the asymmetrical impeller tunnel 38 is vertical, thus righting the 2° slant, when the jet nozzle 36 and the steering nozzle 66 will be parallel to the boat's bottom. To support the impeller shaft 34 on the body 16 the asymmetrical first bearing housing 54 is turned in such a way that the shaft opening 56 of the first bearing housing 54 is located beneath the centre line of the first bearing housing 54. Correspondingly, the packing box is also turned so that the sealing opening is beneath the centre line. In this type of installation, the engine 32 producing drive power for the water-jet unit 10 is a smaller distance from the boat's 12 bottom 72 than in the first type of installation. This type of installation can be used if the boat's engine is such in which the engine's 32 sump 68 is shallow and not as much space is needed under the engine.

Instead of 2° referred to above, the angles Ω and β can both be between 1-3°, when the angle between the impeller shaft and the boat's bottom will be 2-6° in the first type of installation and again parallel to the boat's bottom in the second type of installation.

Figure 2A:
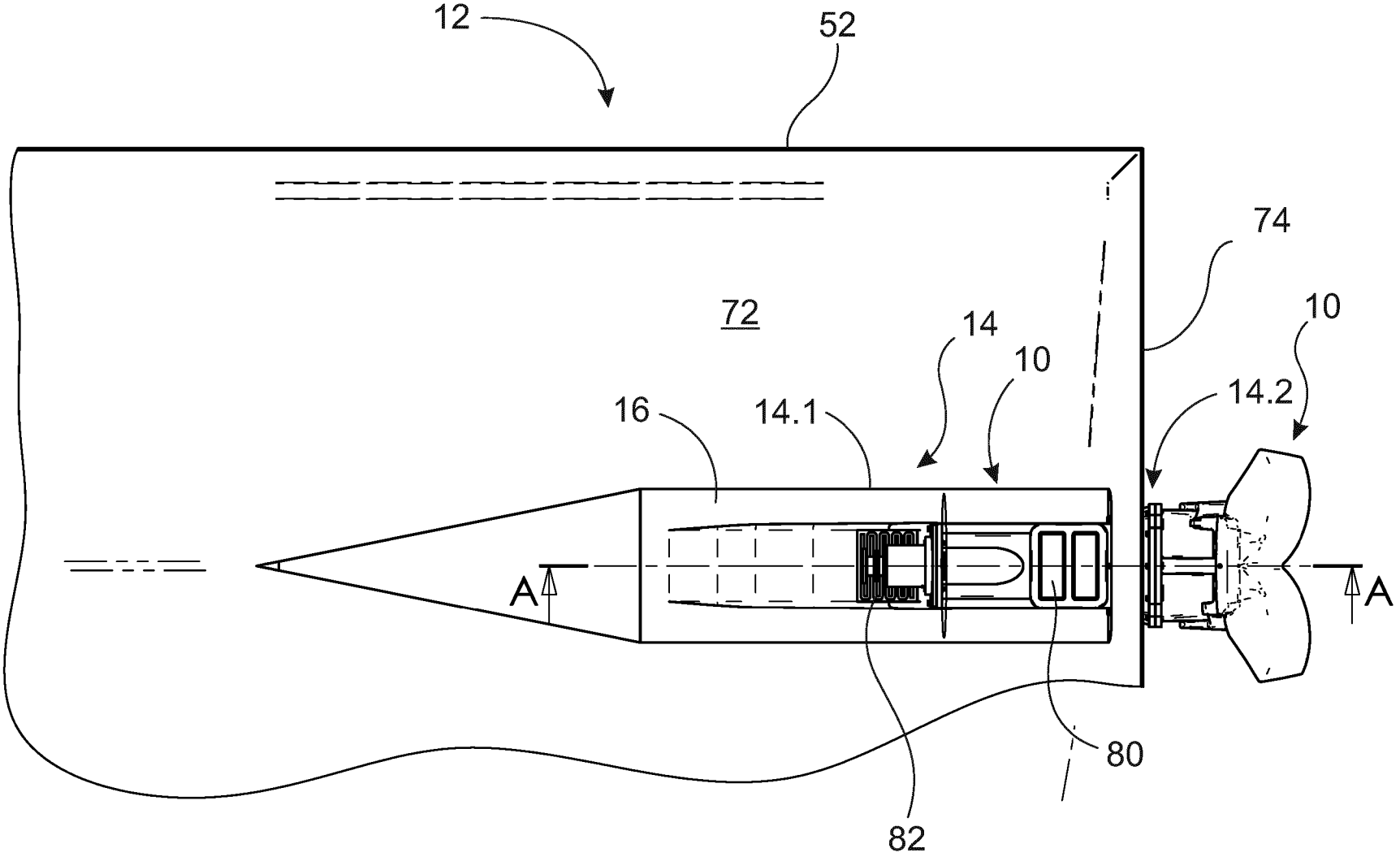
FIG. 2*a* shows the boat and water-jet unit according to the invention seen from above the boat.

In FIGS. 1*a*-1*b* the reference number 64 shows the water jet propulsion unit's 10 reversing scoop, which can be according to the prior art. In FIGS. 1*a*-1*b* and 2*a* the reference number 80 shows an inspection hatch on top of the body 16, through which the user can remove dirt that may have collected in the flow duct.

Figure 2B:
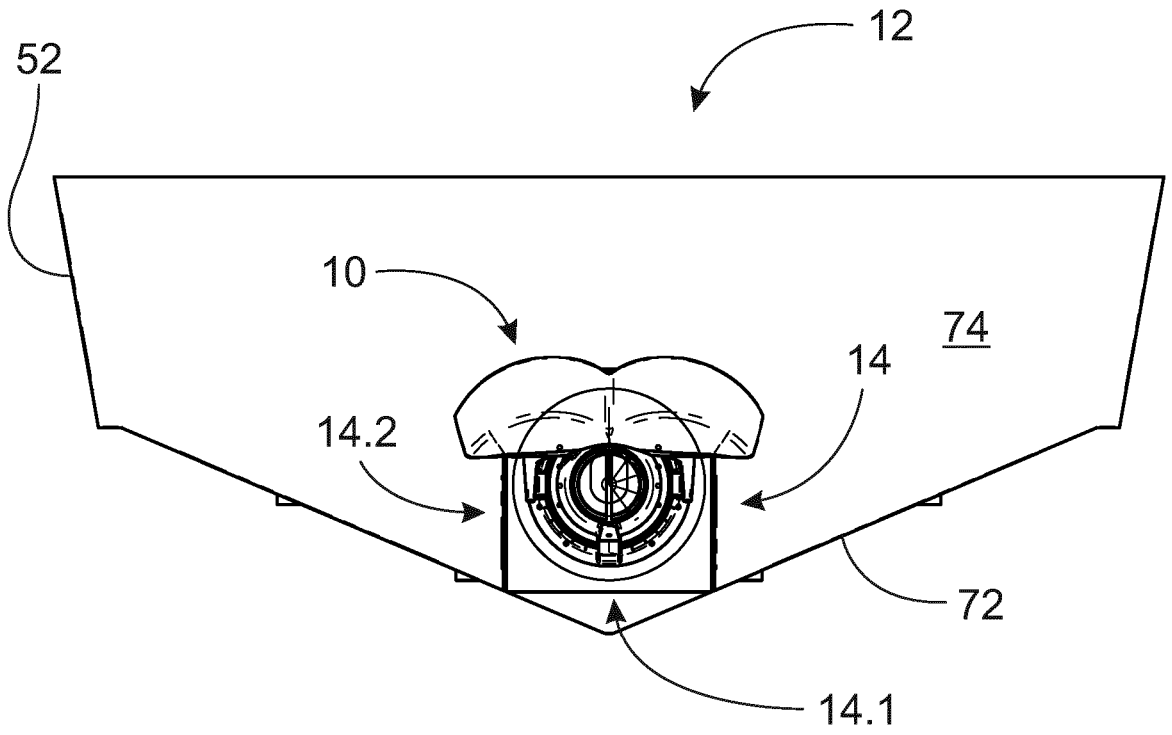
FIG. 2*b* shows the boat and water jet unit according to the invention seen from the rear of the boat.
Figure 2C:
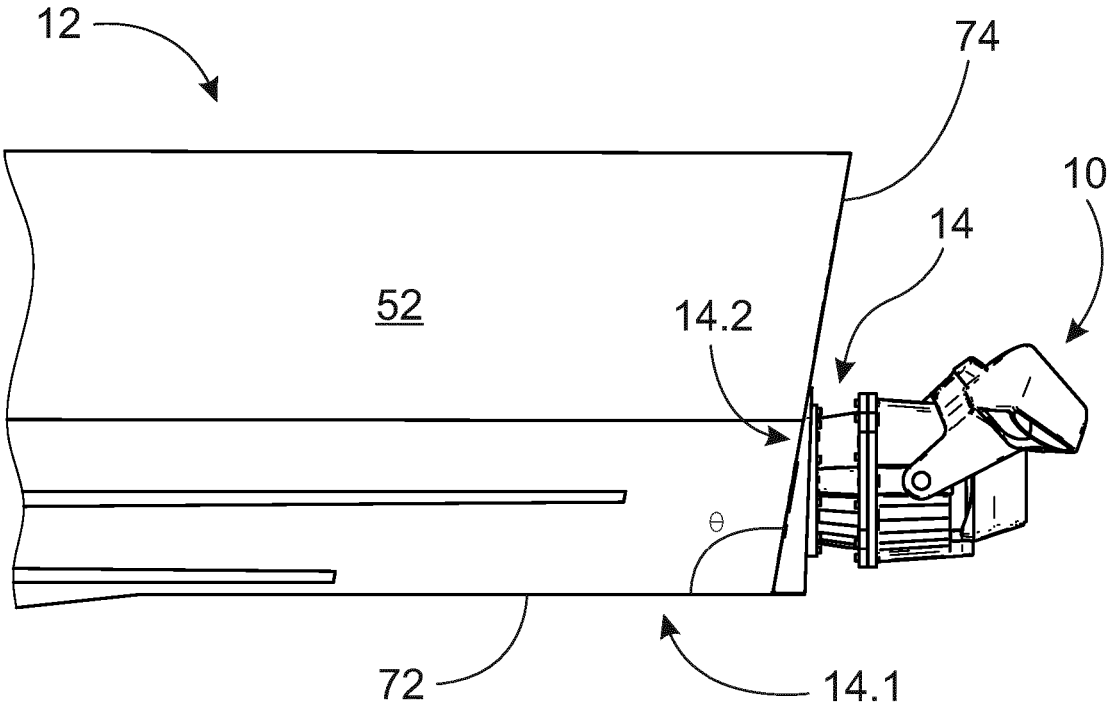
FIG. 2*c* shows the boat and water-jet unit according to the invention seen from the side of the boat.

According to FIGS. 2*a*-2*c*, the water-jet propulsion unit 10 according to the invention is attached to the boat 12 at an attachment point in the stern 74 of the bottom 72 belonging to the hull 70 of the boat 12 at the rear of the boat 12. The boat according to the invention can be manufactured, for example, from glass-fibre, thin metal sheet, or some other similar material used in the manufacture of boats. The boat 12 according to the invention is designed to be used especially with the water-jet unit according to the invention, to permit two different types of installation. According to FIG. 2*b*, for the installation of the water-jet unit 10 the angle θ between the boat's stern 74 and its bottom is chosen to be greater than an ordinary right-angle and the same as the body's angle α. Two different installation angles can then be achieved for the water-jet device by altering the angle of the water-jet unit's impeller tunnel.

The engine to be used in connection with the water-jet propulsion unit is preferably a combustion engine, but it can also be an electric motor. Between the first bearing housing 54 and the connected impeller shaft 34 there can be a clutch arrangement 90. However, the engine 32 is preferably connected to the impeller shaft 34 by a direct drive, i.e. between them there is not a separate vertical-offset gearbox.

FIG. 4*a* shows the construction of the first bearing housing 54 in greater detail. The first bearing housing 54 includes a casing 55, inside which the bearings 84 supporting the impeller shaft 34 are fitted. In addition, the first bearing housing 54 includes an attachment flange 57, to which the casing 55 is attached by bolts 88 in counter-threaded drill-holes 86 in the attachment flange 57. The first bearing housing 54 is sealed to the shaft duct 33 with the aid of a packing box 60. According to FIG. 4*b*, the first bearing housing 54 can be turned through 180° between installation attitude. In FIG. 4*a*, reference number 61 shows a sleeve between the bearings 84 and reference number 63 shows a spring of the mechanical seal pushing the bearing housing towards the impeller shaft.

Figure 4C:
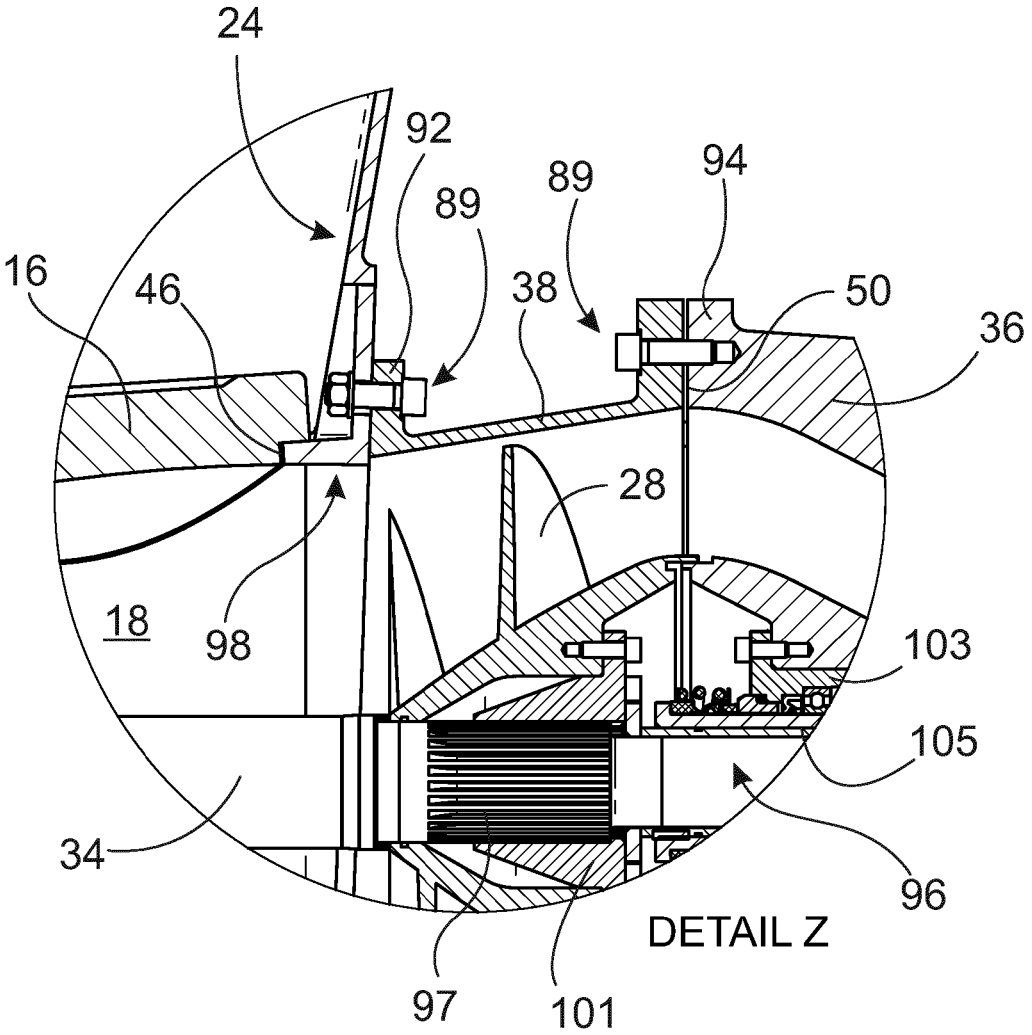
FIG. 4*c* shows an enlargement of detail Z of FIG. 3*b*.
Figure 4D:
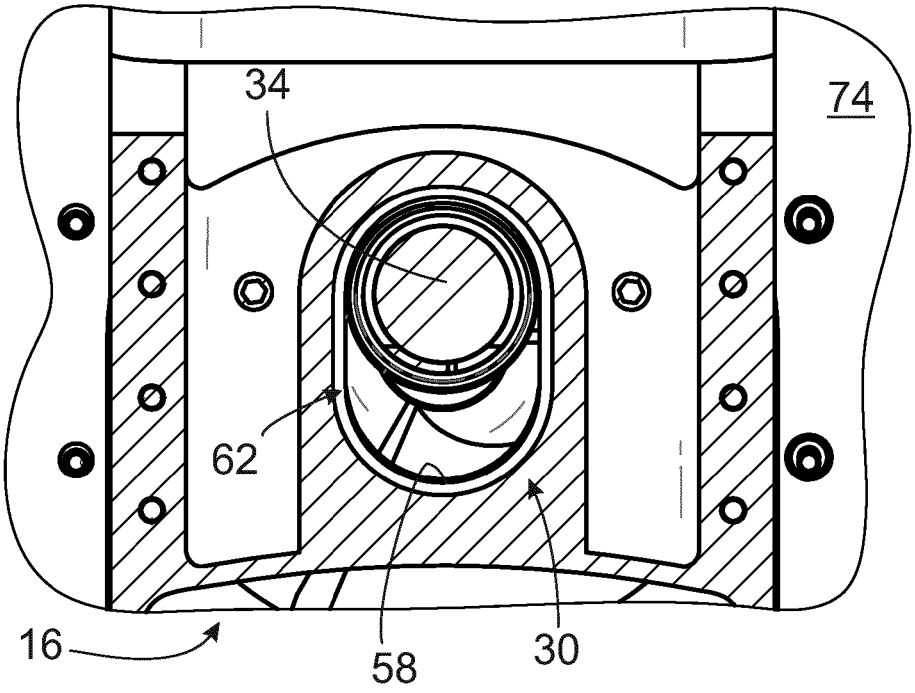
FIG. 4*d* shows cross-section B-B of FIG. 3*a*.

According to FIG. 4*c*, there are grooves 97 in the impeller shaft 34, by which the impeller shaft 34 can be connected to the impeller 28 using a sleeve 101, in which there are counter-grooves. The impeller shaft 34 continues to the second bearing housing 96, in which it is supported by journal bearings 105. As an alternative to journal bearings, rolling bearings can also be used. The second bearing housing 96 is attached to the jet nozzle 36 by the housing 103. From the same FIG. 4*c* it can be seen how the body 16 preferably includes, in connection with the flow duct's 18 outlet opening 26, an installation flange 98, to which the impeller tunnel 38 is attached by bolts 89 through holes 92 in it. A fourth contact surface 24 is formed in the installation flange 98. In turn, the jet nozzle 36 can be attached to the impeller tunnel 38 by bolts 89, using counter-openings 94 in the jet nozzle. In addition to bolts, a sealing mat or adhesive is preferably used in the water-jet unit's joints to ensure sealing of the contact surfaces.

The invention claimed is:

1. A water-jet propulsion unit for a boat having a bottom, a stern and at least one water-jet propulsion unit installation opening, the water-jet propulsion unit being arranged to be installed in and sealed to the at least one water-jet propulsion unit installation opening and including:

an impeller tunnel;

an impeller in the impeller tunnel;

an impeller shaft having a rotational axis and being arranged to drive the impeller for moving water;

a jet nozzle coupled to the impeller tunnel for forming a water jet, a body comprising:

at least a first contact surface for attaching the body to the boat;

a shaft opening for accommodating the impeller shaft; and a flow duct including an inlet opening and an outlet opening, wherein when the body is installed in the boat the inlet opening is parallel to the bottom and the outlet opening is parallel to the stern for guiding water through the flow duct to the impeller, wherein the inlet opening and outlet opening define respective planes which are at an angle α relative to each other, the impeller shaft runs through the flow duct, the impeller tunnel has a first end comprising a planar second contact surface and a second end comprising a planar third contact surface for sealing the impeller tunnel between the body and the jet nozzle, the planar second contact surface and the planar third contact surface are arranged to be at an angle Ω to each other, and the impeller tunnel is arranged to be turned through 180° around the rotational axis of the drive shaft in order to permit first and second alternative angular positions of the impeller shaft, a first bearing housing connected to the body and supporting the impeller shaft on the body; and support equipment for supporting the impeller shaft on the body in each of the first and second alternative angular positions.

2. The water-jet propulsion unit according to claim 1, wherein the angle α exceeds a right-angle by amount of an additional angle β.

3. The water-jet propulsion unit according to claim 1, wherein the shaft opening is a shaft duct for the impeller shaft and the shaft duct includes an enlargement to permit the alternative angular positions of the impeller shaft.

4. The water-jet propulsion unit according to claim 2, wherein the angle Ω equals the additional angle β.

5. The water-jet propulsion unit according to claim 1, wherein the angle α is 91-93° and the angle Ω 1-3°.

6. The water-jet propulsion unit according to claim 1, wherein the support equipment is the first bearing housing, which is asymmetrical, such that the shaft opening is located eccentrically in the first bearing housing.

7. The water-jet propulsion unit according to claim 1, wherein the support equipment is alternative attachment locations belonging to the body for the first bearing housing, and the first bearing housing is symmetrical, the shaft opening being located centrally in the first bearing housing.

8. The water-jet propulsion unit according to claim 3, wherein the shaft duct has an ovally or elliptically-shaped cross-section in a radial direction of the impeller shaft.

9. The water-jet propulsion unit according to claim 1, wherein the water-jet propulsion unit includes a packing box for sealing the impeller shaft to the body, which packing box comprises a sealing opening with an oval shape in a vertical direction for the impeller shaft.

10. The water-jet propulsion unit according to claim 1, wherein the impeller tunnel is in one piece.

11. The water-jet propulsion unit according to claim 1, wherein the body of the water-jet propulsion unit is in one piece.

12. The water-jet propulsion unit according to claim 1, wherein a second bearing housing is integrated with the jet nozzle to support the impeller shaft.

13. The water-jet propulsion unit according to claim 1, wherein the first contact surface is arranged in connection with the inlet opening and the flow duct includes, in addition, a fourth contact surface arranged in connection with the outlet opening, the flow duct being arranged to be installed inside the boat, and the inlet opening and the outlet opening being aligned with the boat's installation openings.

14. The water-jet propulsion unit according to claim 13, wherein the body includes an installation flange, in which the outlet opening and the fourth contact surface are formed.

15. A boat, comprising:

a hull comprising a bottom, sides, and a stern;

the water-jet propulsion unit according to claim 1 installed in the hull;

an engine coupled to the water-jet propulsion unit and installed inside the hull; and installation openings for the water-jet propulsion unit, including a first installation opening arranged in the bottom and a second installation opening arranged in the stern, wherein an angle θ between the boat's bottom and the stern is equal to the angle α of the water-jet propulsion unit.

16. The boat according to claim 15, wherein the engine is connected by a direct drive to the water jet propulsion unit.

* * * * *